US005350172A

United States Patent [19]

Garrett et al.

[11] Patent Number: 5,350,172

[45] Date of Patent: Sep. 27, 1994

[54] BASEBALL PITCH TO WIN APPARATUS

[76] Inventors: Richard M. Garrett, 15 Bronwood Dr., Voorhees, N.J. 08043; Al Holland, 3523 Cove Rd. NW., Roanoke, Va. 24017

[21] Appl. No.: 959,636

[22] Filed: Oct. 13, 1992

[51] Int. Cl.[5] ..... A63B 69/40

[52] U.S. Cl. ..... 273/26 A

[58] Field of Search ..... 273/26 R, 25

[56] References Cited

U.S. PATENT DOCUMENTS

| | | | |
|---|---|---|---|
| 2,122,266 | 6/1938 | Leys | 273/25 |
| 2,964,316 | 12/1960 | Rose | 273/26 R |
| 4,445,685 | 5/1984 | Cardieri | 273/26 R |
| 4,456,250 | 6/1984 | Perrone | 273/26 R |
| 4,886,267 | 12/1989 | Licciardi | 273/26 R |
| 4,938,478 | 7/1990 | Lay | 273/26 R |
| 4,962,924 | 10/1990 | James | 273/26 R |
| 5,004,234 | 4/1991 | Hollis | 273/26 R |

OTHER PUBLICATIONS

Popular Science, p. 183, Mar. 1959.

*Primary Examiner*—Theatrice Brown

*Attorney, Agent, or Firm*—David Edwards

[57] ABSTRACT

A baseball pitching training apparatus is provided for developing and improving pitching skills for beginning pitchers to professional pitchers. This apparatus comprises a planar base representative of a baseball home plate with first, second, and third poles vertically mounted in slots in the planar base. The poles have targets mounted on their upper ends and are arranged in a triangular pattern. The poles also have recoil means located in each of them to cause each of said poles to return to its normal vertical position after being struck by a thrown ball.

9 Claims, 5 Drawing Sheets

BASEBALL PITCH TO WIN APPARATUS

BACKGROUND OF THE INVENTION

This invention relates to a practice apparatus for baseball pitchers.

Prior to the present invention, many devices existed to help a baseball pitcher practice his pitching into a strike zone which includes or excludes some target gear, such plate, net, a loop, or the like. In actual pitching, however, control of the ball for pin-point accuracy on demand is the ultimate goal of every pitcher. Pitching the ball only over the center of the plate, at the right height will result in more base hits, which is the opposite of what the pitcher wants or intends. A pitcher wants to be able to pitch the ball to the outside edges of the plate, to the inside edges of the plate, or the corners of that area defined as the strike zone, preferable while at the same time keeping the ball low or high depending upon whether he desires to pitch an inside or outside pitch. In this manner, the batter is generally not able to put full and direct force into the ball, thus causing pop flies, grounders, foul balls, and strikes rather than base hits. Hence, a pitcher needs a training device that will give him direct feed back that he can see instantaneously while practicing throwing the ball at different zones.

U.S. Pat. No. 4,819,937 discloses a portable baseball practice tee or a strike zone indicator device. As a pitching device, a pair of adjustable stanchions are mounted in extenders so that they straddle the base. Indicators such as color bands on the stanchion surfaces provides the high-low range of the strike zone. U.S. Pat. No. 2,978,246 discloses a target device for baseball pitches composed of a target member suspended on a recoilable pole member.

SUMMARY OF THE INVENTION

This invention is directed to a baseball pitching training apparatus for developing and improving pitching skills comprising (a) a planar base plate representative of home placate with three slots therein situated in a triangle pattern with the slots at the corners of the triangle, (b) a first pole means adapted for vertical mounting in one of said slots and having mounted on its top end a target means located at the optimum lower height in the strike zone, (c) a second pole means adapted for vertical mounting in the second slot having mounted on its top end a second target means located at the optimum lower height in the strike zone wherein the first and second pole means form a straight line normal to a projectory of a baseball thrown at either of the pole means, (d) a third pole means adapted for vertical mounting in the third slot having mounted on its top end a third target means located at the optimum upper limit height in the strike zone wherein this third pole means forms the apex for the triangle, (e) recoil means located in each of the first, second-,and third pole means for rebounding to its original position after being struck by a thrown ball, and (f) ball retaining net means adapted to be situated behind the planar base plate for catching a thrown ball.

This invention also comprehends second and third operational modes that are used after a pitcher has mastered the basic device. In the second embodiment, outside perimeters targets are added to the first and second primary targets. These outside lower perimeter targets adds another dimension in skill control for throwing inside and outside pitches that are the ultimate strike zones; these pitches are practically unhittable by batters. When a pitcher progresses to this level of precision pitching, he has reached a professional level of pitching that could make him a premier player.

After a pitcher has mastered this second operation mode of pitching, inside targets can be added to the first and second primary targets for adding yet another dimension to the pitchers throwing ability. This level of playing provide the ultimate level of ball handling skills. The type of pitches that are practiced at this level using the third mode are the sinking balls that are come across the plate but sink; the balls can either be curved balls that sink or straight ball that sink. This mode improves eye to hand coordination ball skill control which is the highest proficiency for ball control. This provides the professional pitcher with yet another tool in his arsenal of pitches for striking out batters.

DETAILED DESCRIPTION ON THE INVENTION

The pitch to win machine/system of this invention is a piece of sports equipment engineered and designed to take high impacts abuse over a long period of time. The abuse to the device comes from a thrown ball by a pitcher who is practicing for a game where throwing a ball is essential in the game; the ball may be a hardball, softball, rubber ball, or any type of ball that is thrown. The thrown ball is directed towards and at a strike zone with recoiling strike pads mounted on a home plate strike zone, diamond shaped base of regulation size and dimensions for the particular game; the dimensions are variable depending on the game for which a person is practicing. The distance to the home plate from the pitching mound is normally from five feet to sixty five feet or is a specific distance regulated by official rules of the particular leagues of baseball and softball, such as 45 feet, 54 feet, and 60 feet 6 inches. The unit is used with a variety of size and weight balls, to be thrown under hand, over hand, or side arm. All pitching to this device can be either left or right handed and a catcher is never necessary. The games in which this device is particularly useful for practicing are, for example, baseball, softball, little league, pony league, junior league, big league, professional baseball, etc.

This device is an aid for developing and/or improving pitching and throwing skills and motor functions, eye/hand coordination, visual perception, depth perception and physical control, accuracy and speed in delivery. This device will enable a pitcher to learn, enhance, and improve ball throwing control to an optimum strike zone that is identifiable by visual contact of strike targets. The speed, accuracy, and control of a pitch can be visually measured by the direct reaction of the impact of the targets in the strike zone only. The harder the target is hit the more violent the coil rebound will be. The strike zone is measured to be from elevated knee height to shoulder height; for an average adult male player about 23 inches from the ground is the knee height and about 60 inches from the ground is the shoulder height for a narrow band of 37 inches to pitch over a white diamond outlined in black with a 260 square inch area. The balls are caught by a net in a frame. The optimum strike zone is a narrow band of 17 to 19 inches as measured at a low level of 19 inches for the ground to a high of 32 inches from the ground. This level is the optimum because it is the most difficult zone for any batter to hit. This optimum strike zone will cover all batters regardless of their height because most batters knees from the ground is at least 17 inches, even little league players.

Figure 1:
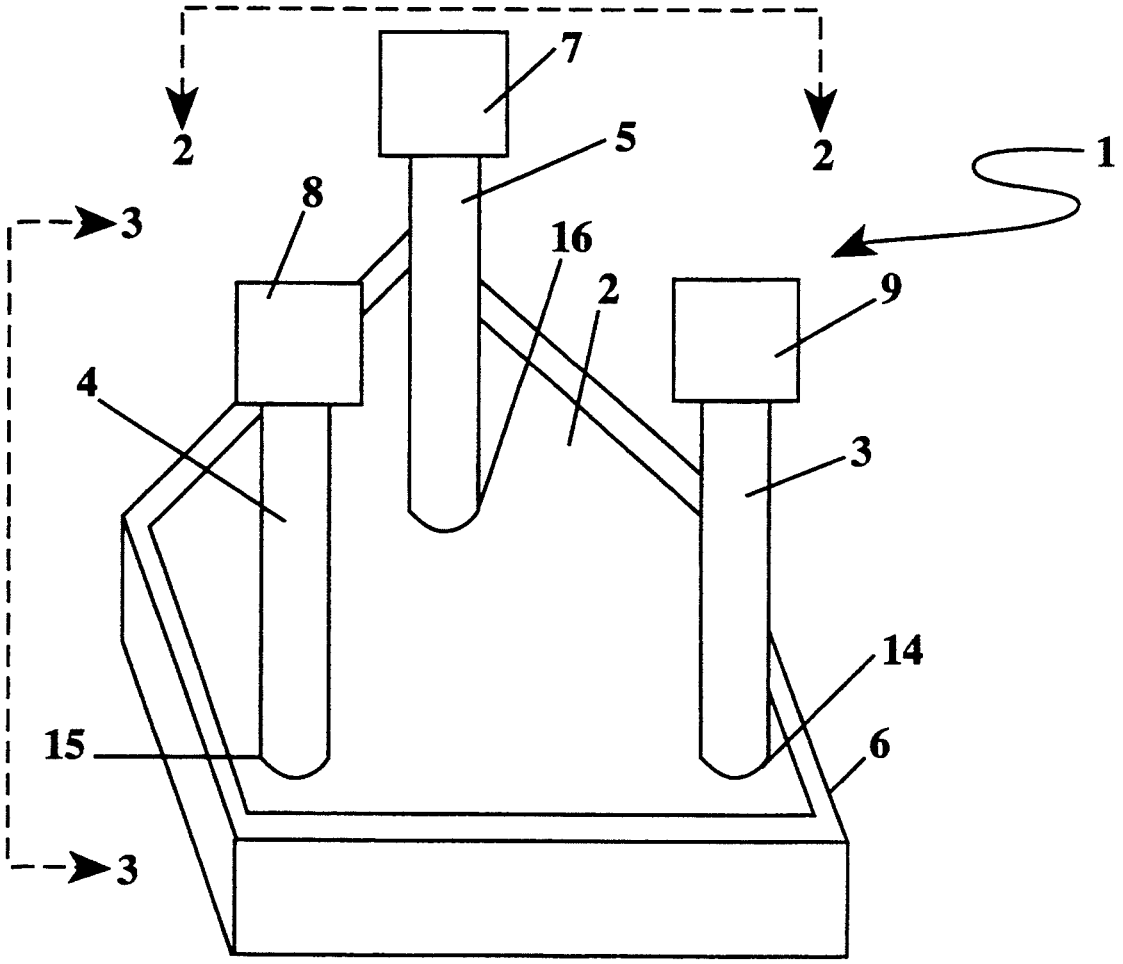
FIG. 1 is a perspective view of the basic practice device 1.

With reference to FIG. 1, a perspective view of an illustrative embodiment of the pitch to win baseball practice machine/system 1 depicting the basic mode of the invention is shown. Machine/system 1 includes poles 3,4, and 5 affixed to the home plate 2 in slots 14,15, and 16 in plate 2. Poles 3 and 4 are affixed at their bottom ends in slots 14 and 15 a certain same height above the plate 2 at the corners of an imaginary triangle on home plate 2; targets 8 and 9 are attached to the top ends of poles 3 and 4. Pole 5 is attached in slot 16 at its bottom end and target 7 is attached to the upper end of pole 5 at a second height above plate 2. Targets 8 and 9 are the same color while target 7 would be a different contrasting color; targets 8 and 9 define the lower limit of the optimum strike zone and target 7 define the upper limit of the optimum strike zone. Home plate 2 has a border 6 around it of a contrasting color with the plate 2 for outlining the plate. Anchoring means (not shown) are also attached to the home plate 2 for affixing the machine in position for throwing practice.

Figure 2:
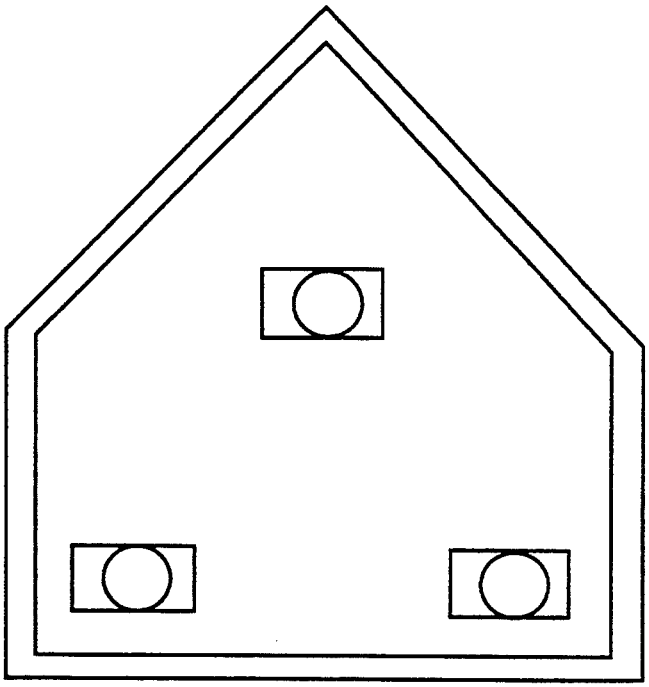
FIG. 2 is a top view of the basic practice device 1 taken along lines 2—2 shown in FIG. 1.
Figure 3:
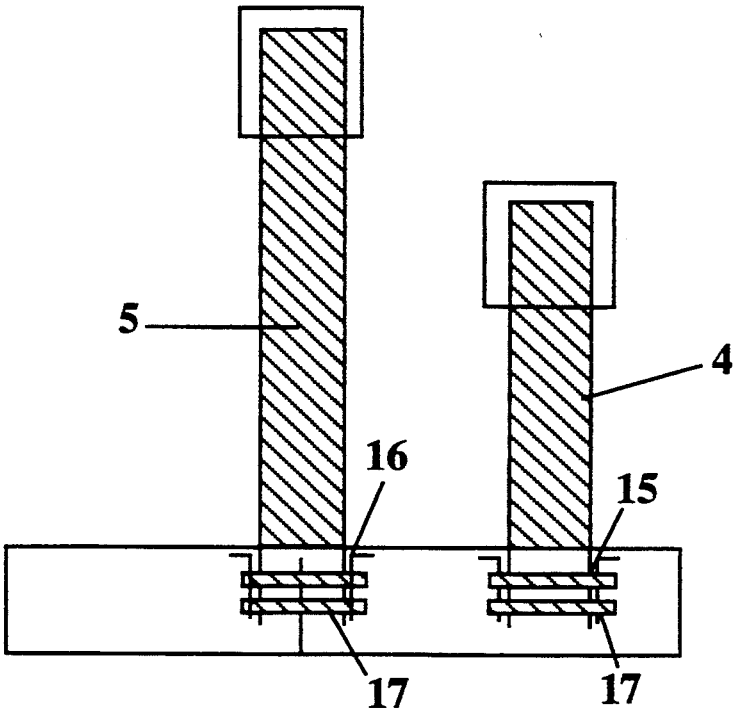
FIG. 3 is a side cut away view of the basic practice device of this invention along lines 3—3 shown in FIG. 1.

FIG. 2 is a top view of the machine 1 taken along lines 2—2 showing the triangular shape of the three poles 3, 4, and 5 with targets 7, 8, 9. FIG. 3 is a cut-away section of machine 1 taken alone lines 3—3 showing the affixing means 17 for attaching poles 4 and 5 in slots 15 and 16. FIG. 3 also show the relative heights of the targets 7, 8, 9 that define the optimum strike zone. In FIG. 3, pole 3 would be directly in back of 4 so that it is not seen in this figure.

Figure 4:
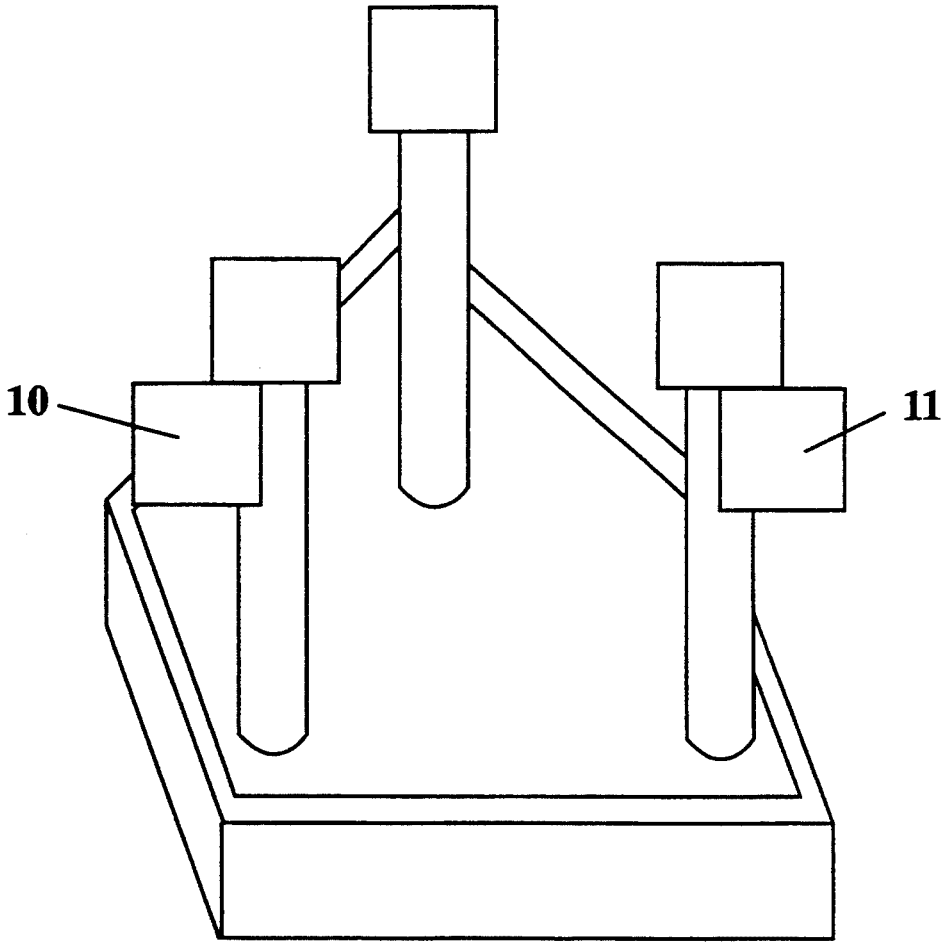
FIG. 4 is a perspective view of a second mode of operation of the practice device.
Figure 5:
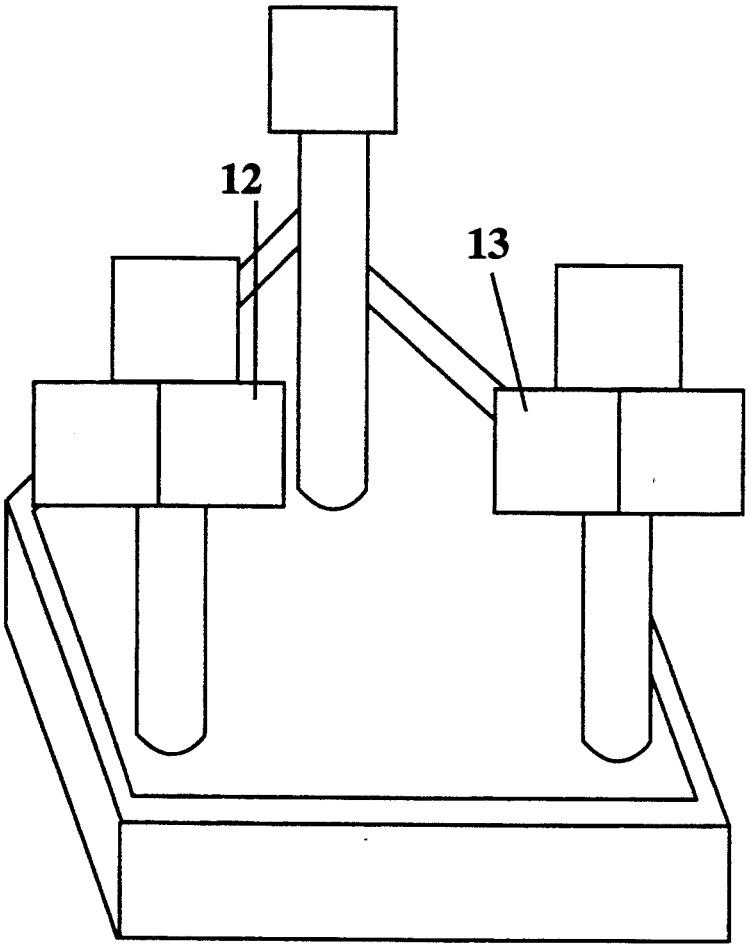
FIG. 5 is a perspective view of a third mode of operation of the practice device of this invention.

FIG. 4 shows a second operational mode for practicing more advanced skills that includes targets 10 and 11 attached to poles 3 and 4. This mode of practice should be used only after a person has mastered the basic mode of practice. FIG. 5 shows the third operational mode for practicing expert skills that are normally mastered only by professional players. This third mode should be attempted only after a pitcher has mastered the first two modes of operation.

The targets 7, 8, and 9 are impact pads that absorb impact energy, unlike any other pitching practice device. The impact causes a reaction with a coil spring shaft in poles 3, 4, 5 as a rebound that can be measured to determine the velocity of the thrown ball and quality of solid impact. The recoil springs (not illustrated) and impact pads can be connected to electric contacts and pressure plates in the strike zone pads to give feedback for measuring ball speed. The unit can also measure the quality of ball control to individual colors struck in the strike zone. The contacts and pressure plates can be connected to a computer for direct feed back on impact and accuracy in order to assist a pitcher in developing pitching skills and training habits.

Operating procedures range from the basic three strike pads to the more advanced five pads to the expert seven pads. The three pads are to develop training skills for throwing accuracy. The five pads are to develop training skills for outside and inside pitches. The seven pads are to define skills of control and accuracy to inside and outside pitches with a five inch linear plane of accuracy. With seven pads the pitching accuracy can be fine tuned within inches and further defined control practices.

A high degree of direction can be given to the thrower as to what color pad to hit, such as center, inside right, inside left, outside right, outside left, etc. The instruction to a thrower could identify colors such as center yellow, outside red, inside red, outside corner yellow, inside corner yellow, outside corner blue, inside corner green, etc. The machine colors can be varied for therapy and color blindness. The basic three strike pads will be yellow center with red left and right. The five pad unit will be yellow center, red right and left and blue right and green left. The seven pad unit will be yellow center, red left and right, blue and yellow right and green and yellow left.

Examples of the type of materials that the system can made are as follows: the base plate can be made of wood, metal, rubber or plastic materials with a high impact rubber or plastic around the perimeter for protection; regardless of what materials the poles are made, they are coated with a hard rubber or plastic that could withstand high impact. The pads can be made of any materials that are high impact that can withstand repetitive abuse such as rubber or metal or plastic. The top pads of the basic unit are attached to the poles by compression plugs or high tension clamps or any other means that will not be broken easily. The pads for the second and third operational modes are attached to the poles by jaw clamps or any removable compression clamp that can withstand high impact.

The recoil and rebound of the poles to the reset position is usually achieved in four motions or less; this is achieve by selecting the weight of the ball to be thrown and the tensile strength of the recoil means in a proper ratio as would be well known to designing engineers in this art. The recoil means can be in the form of coil springs as the poles or can be coil springs located in the center of the poles or the coil spring can be located on the outside a resilient core that has a high enough resiliency level for rebounding in this time frame (i.e., in four or less motions). Other recoil meats such resilient rubber or plastic can also be used either along or in combination with other materials as the recoil means as long as it rebounds in a short time period and can withstand muck abuse without breaking. Regardless of how hard the target is hit, the recoil means should enable the pole to be reset in four or less cycles. Regardless of what form the recoil means takes, it is the core plug, located in the interior of the spring, that controls the rebound and reflect action of the spring. In certain embodiments, the core plug can be the recoil means itself. This core plug can be made of any material that can withstand high impact and has durability (such as plastics, rubbers, metal, wood, and the like).

Means for anchoring this device to a stationary position either on the ground or to a floor is designed into the device by controlling the weight ratio of the device to its mechanical reflect action when a pad is struck by a ball. This device is 100% impact absorbing design so that it will absorb any amount of energy involving the specific weight of the ball being thrown. For instance, the core plug in the spring controls the rebound and absorbing quality directly related to the object being thrown. The difference is the weight of a hardball and a soft ball.

It is to be understood that the baseball practice device illustrated herein is not limited to specific forms by way of example and illustration, but may assume other embodiments limited only by the scope of the appended claims.

What is claim:

1. A baseball pitching training apparatus for developing and improving pitching skills comprising (a) a planar base representative of a baseball home plate, said base having three slots therein arranged in a triangle pattern, (b) a first pole having a first predetermined length and being mounted vertically in a first one of said slots, said first pole having mounted on its upper end a target, said predetermined length being the optimum lower height of the batting strike zone, (c) a second pole having a predetermined length and being mounted vertically in a second one of said slots, having mounted on its upper end a target, said second predetermined length being the optimum lower height of said batter strike zone, and first and second poles being spaced apart a predetermined straight line distance, said predetermined distance between said first and second poles being substantially normal to a ball thrower positioned facing said base, (d) a third pole having a third predetermined length and being mounted vertically in a third one of said slots, said third pole having mounted on its upper end a target, said third predetermined length being the optimum upper limit height of said strike zone, said third pole being located at the apex of said triangular pattern, said first and second predetermined lengths being equal and said third predetermined length being greater than said first and second predetermined lengths, (e) recoil means located in each of the first, second, and third poles to cause said poles to return to its normal vertical position after being struck by a thrown ball.

2. The apparatus of claim 1 wherein the recoil means is a recoil spring.

3. The apparatus of claim 1 wherein the optimum lower limit height is 19 inches from the ground.

4. The apparatus of claim 1 wherein the optimum upper limit height is 32 inches from the ground.

5. The apparatus of claim 1 wherein in addition to said target, an outside target is attached to the first and second poles.

6. The apparatus of claim 1 wherein in addition to said target an outside target and an inside target is attached to the first and second poles.

7. The apparatus of claim 6 wherein the outside and inside targets are different colors.

8. The apparatus of claim 1 wherein the targets on said first and second poles are a first color and the target on the third pole is a different contrasting color.

9. The apparatus of claim 1 wherein said targets mounted on said first, second, and third poles are in alignment with the vertical axis of said poles.

* * * * *